United States Patent [19]

Morishita et al.

[11] Patent Number: 4,735,559

[45] Date of Patent: Apr. 5, 1988

[54] SCROLL-TYPE VACUUM PUMP WITH OIL SEAL BETWEEN SUCTION AND DISCHARGE CHAMBERS

[75] Inventors: Etsuo Morishita; Masayuki Kakuda; Yoshihisa Kitora; Tetsuo Hirai, all of Amagasaki, Japan

[73] Assignee: Mitsubishi Denki Kabushiki Kaisha, Tokyo, Japan

[21] Appl. No.: 22,086

[22] Filed: Mar. 5, 1987

[30] Foreign Application Priority Data

Mar. 7, 1986 [JP] Japan ..... 61-50817

[51] Int. Cl.[4] ..... F04C 18/04; F04C 27/02; F04C 29/02

[52] U.S. Cl. ..... 418/2; 418/55; 418/57; 418/96; 418/100; 418/151; 418/188

[58] Field of Search ..... 418/2, 55, 57, 96, 100, 418/151, 188

[56] References Cited

U.S. PATENT DOCUMENTS

| | | | |
|---|---|---|---|
| 2,883,101 | 4/1959 | Kosfeld | 418/96 |
| 3,386,648 | 6/1968 | Van Rossem | 418/2 |
| 3,600,114 | 8/1971 | Dvorak et al. | 418/57 |
| 3,884,599 | 5/1975 | Young et al. | 418/55 |
| 4,475,874 | 10/1984 | Sato | 418/57 |
| 4,597,724 | 7/1986 | Sato et al. | 418/151 |

FOREIGN PATENT DOCUMENTS

| | | | |
|---|---|---|---|
| 2338808 | 2/1974 | Fed. Rep. of Germany | 418/55 |
| 57-70984 | 5/1982 | Japan | 418/55 |
| 58-110886 | 7/1983 | Japan | 418/151 |

*Primary Examiner*—John J. Vrablik

*Attorney, Agent, or Firm*—Oblon, Fisher, Spivak, McClelland & Maier

[57] ABSTRACT

An upper housing for rotatably supporting a driving scroll in a sealing container is provided with an annular chamber to be maintained at the atmospheric pressure. The annular chamber is communicated with a compression chamber formed between the driving and driven scrolls through a discharge conduit which is formed in the driving shaft of the driving scroll. The annular chamber is communicated with the inside of the container through a throttling path. An oil stored in the lower part of the container is induced with the compression chamber during the revolution of the both scrolls to be introduced into the annular chamber. Owing to the throttling path, the oil is stored in the annular chamber to separate the inside of the container and the annular chamber kept at the atmospheric pressure.

6 Claims, 3 Drawing Sheets

FIGURE 4 (a) 0°
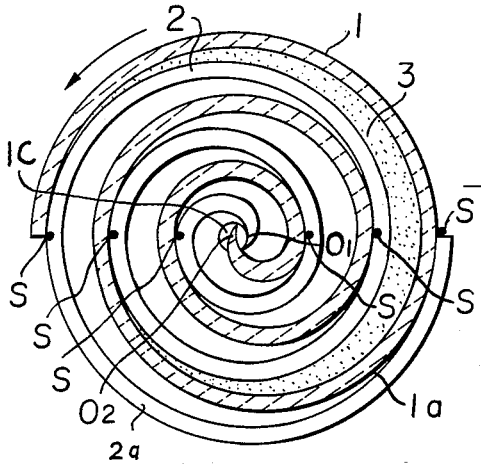
FIGURE 4 (b) 90°
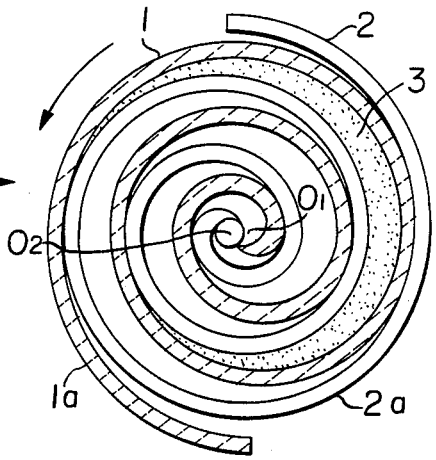
FIGURE 4 (d) 270°
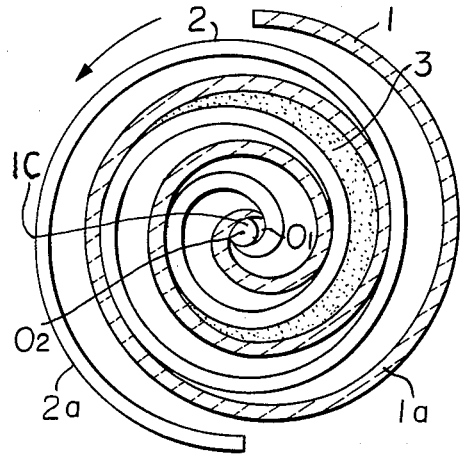
FIGURE 4 (c) 180°
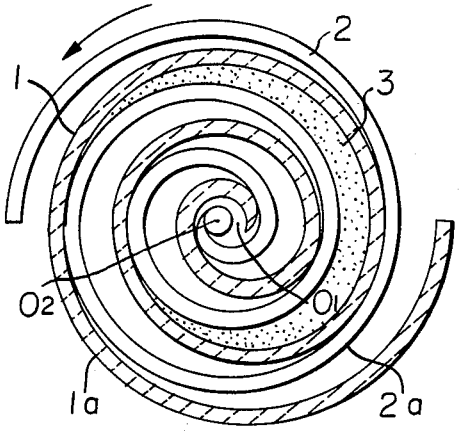

SCROLL-TYPE VACUUM PUMP WITH OIL SEAL BETWEEN SUCTION AND DISCHARGE CHAMBERS

BACKGROUND OF THE INVENTION

1. Field of the Invention

The present invention relates to a scroll-type vacuum pump utilizing the principle of a total system rotation type scroll compressor in which a driven scroll is directly rotated by a driving scroll.

2. Discussion of Background

The principle of the scroll compressor has been known. The scroll compressor is a kind of a positive displacement type compressor in which a pair of scrolls are combined with each other and rotated to effect compression of a fluid.

In the ordinary scroll compressor, one of the scrolls is made stationary and the other is subject to an orbital movement with respect to the stationary scroll to effect the compression.

The principle of the total system rotation type scroll compressor in which both scrolls are respectively rotated around their own axial center, is also well known.

FIG. 4 shows the principle of the total system rotation type scroll compressor. A driving scroll 1 is caused to rotate around its own axial center $O_1$ by a driving source such as a motor, an engine, a turbine and so on. A driven scroll 2 is also caused to rotate around its axial center $O_2$ in synchronism with the rotation of the driving scroll 1. A compression chamber 3, which is formed by combining the driving and driven scrolls 1, 2, moves toward the rotation centers as the both scrolls rotate while the volume of the chamber 3 is gradually reduced. The pressure of a gas confined in the compression chamber 3 increases and a highly pressurized gas is discharged through a dischage port 1*c*.

FIG. 4*a* shows a state of the combined driving and driven scrolls 1, 2 at its moving phase of 0°, in which the gas is sucked in the compression chamber 3. As the scrolls rotate, they assume the moving phases of 90°, 180°, 270°and 360° (0°) succesively as shown in FIGS. 4*b*–4*d*, whereby the compression chamber 3 gradually shifts toward their revolution centers with the result of reduction in the volume of the gas. The two scrolls 1, 2 provide sealing portions by mutual contact of the side walls of the wrap plates 1*a*, 2*a* of the scrolls 1, 2. As shown in FIG. 4, the sealing portions s are in alignment with each other in the radial direction of the driving and driven scrolls 1, 2; namely, they always occupy a constant positional relation in view of a static condition of the scrolls.

In the conventional scroll compressor, it is extremely difficult to provide a state where a suction chamber is maintained at a highly vacuumed condition compared to the discharge side of the container. Thus, a technique of applying the principle of the scroll compressor to a vacuum pump has not been proposed.

SUMMARY OF THE INVENTION

It is an object of the present invention to provide a scroll-type vacuum pump utilizing the principle of the scroll compressor; having an simple structure and is highly reliable.

The foregoing and the other objects of the present invention have been attained by providing a scroll-type vacuum pump which comprises a container of a cylindrical form which is provided with a gas inlet for introducing gas, a driving scroll rotatably placed inside the cylidrical container, the driving scroll comprising a wrap plate extending downwardly and a driving shaft extending upwardly in which a discharge conduit is formed along its axial center, a driven scroll having a wrap plate which is placed below the driving scroll so as to be driven by the same through the mutual contact between the both wrap plates, a lower housing for gas-tightly closing the bottom of the cylindrical container and supporting the driven scroll through a bearing, an upper housing for gas-tightly closing the top of the cylindrical container, which comprises a bearing supporting part for supporting the driving scroll through a bearing, an annular chamber formed at the outer circumferential portion of the bearing supporting part so as to maintain the atmospheric pressure and an opening passing through the bearing supporting part in the radial direction to communicate the discharge conduit with the annular chamber, a driving source mounted on the upper housing and having a rotary shaft connected to the driving shaft of the driving scroll, an oil storing portion formed in the lower part of the container, and a throttling path formed between the lower surface of the upper housing and the upper surface of the driving scroll, the annular chamber being communicated with the oil storing portion through the throttling path, wherein oil is taken in a compression chamber by the associated revolution of the driving and driven scrolls and is fed in the annular chamber kept at the atmospheric pressure where the oil is separated from the compressed air and to be stored on the bottom of the annular chamber by the throttling action of the throttling path, whereby the oil hermetically seals a suction chamber in the container to the annular chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 4(*a*)–4(*d*) are diagrams showing the principle of the operation of the typical total system rotation type scroll compressor.

DESCRIPTION OF THE PREFERRED EMBODIMENTS

Figure 1:
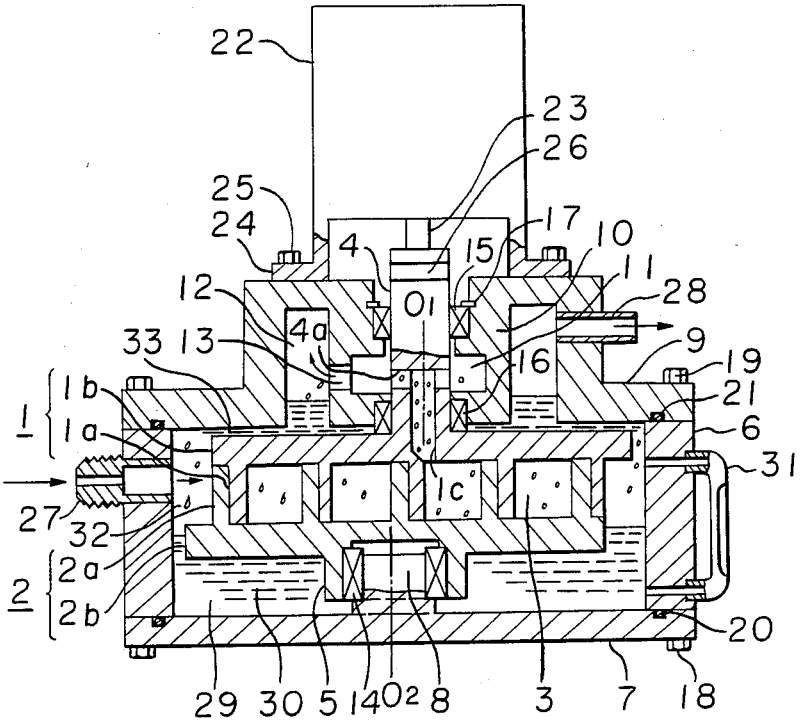
FIG. 1 is a longitudinal cross-sectional view of an embodiment of the scroll-type vacuum pump according to the present invention.

Referring now to the drawings, wherein like reference numerals designate identical or corresponding parts throughout the several views, and more particularly to FIG. 1 thereof, there is shown a longitudinal cross-sectional view of the scroll-type vacuum pump according to the present invention. In FIG. 1, a reference numeral 6 designates a generally cylindrical container which is placed with the axial center kept upright. A driving scroll 1 is placed at the upper part of the container 6 and it has a circular plate 1*b*, a wrap plate 1*a* formed on the lower surface of the circular plate 1*b* and a driving shaft 4 extending upwardly. The driving shaft 4 is firmly attached to or integrally formed with the circular plate 1*b* and is provided with a discharge conduit 1*c* extending along the axial center $O_1$ and a plurality of discharge ports 4*a* formed in the shaft in the radial direction to communicate the discharge conduit 1*c* with the outer circumferential surface of the driving shaft 4. A driven scroll 2 is placed below the driving scroll 1 and a wrap plate 2*a* formed on the upper surface of a circular plate 2*b* is combined with the wrap plate 1*a* of the driving scroll 1 so as to be driven through the driving scroll by the mutual contact of the wrap plates 1*a*, 2*a*. A boss 5 is formed on the lower surface of the circular plate 2*b* of the driven scroll 2.

A lower housing 7 is attached to the bottom of the container 6 by means of bolts 18. An O-ring 20 is interposed between the lower surface of the container 6 and the upper surface of the lower housing 7. A cylindrical projection 8 is formed on the lower housing to support the driven scroll 2 through a bearing 14.

An upper housing 9 is attached onto the top of the container 6 by means of bolts 19 through an O-ring 21 in a gas-tight manner. A cylindrical bearing-supporting part 10 is formed at the center of the upper housing 9. The driving shaft 4 of the driving scroll 1 is supported by the bearing supporting part 10 through a bearing means so as to be rotatable with respect to the upper housing 9. An annular discharge chamber 11 is formed in the inner circumferential portion of the bearing supporting part 10. An annular chamber 12 maintained at the atmospheric pressure is formed at the outer circumferential portion of the bearing supporting part 10. A discharge tube opening 28 extends passing through the outer wall of the annular chamber 12 to communicate the interior of the annular chamber 12 with the outside. A communication hole further opening 13 is formed in the bearing supporting part 10 to communicate the discharge ports 4*a* formed in the driving shaft 4 with the annular chamber 12. Numerals 15 and 16 designate bearings fitted to the bearing supporting part 10 to support the driving shaft 4 and a numeral 17 designates a C-shaped snap ring for restricting the upward movement of the bearing 15. The bearings 14, 15 and 16 may be of a radial-thrust type.

A driving source 22 such as a electric motor is mounted on the upper housing 9 by connecting the flange 24 by means of bolts 25. The rotary shaft 23 of the motor 22 is connected to the driving shaft 4 through a coupling 26. A mouth ring 27 such as a suction tap is connected to the side wall of the cylindrical container 6 to introduce gas into the container 6. An oil reservoir 29 is provided at the bottom of the container 6 to store oil 30.

An oil guage 31 is attached to the side portion of the container 6 to indicate the surface level of the oil stored in the container 6. A suction chamber 32 is defined by the inner walls of the container 6 and the upper and lower housings 7, 9. A reference numeral 33 designates a throttling path formed between the upper surface of the circular plate 1*b* of the driving scroll 1 and the lower surface of the upper housing 9.

The operation of the vacuum pump of the embodiment mentioned above will be described.

On actuation of the motor 22, the driving scroll 1 is rotated around the axial center $O_1$, hence the driven scroll 2 is rotated around the axial center $O_2$ through the mutual contact of the wrap plates 1*a*, 2*a*. The associated revolution of the both scrolls 1, 2 effects a series of operations of suction, compression and discharge of the gas as illustrated in FIG. 4.

The associated revolution of the scrolls 1, 2 causes suction of the gas into the suction chamber 32 through the mouth ring 27. Then, the oil 30 is entrained in the compression chamber in a form of mist together with the sucked gas. During the movement of the compression chamber toward the revolution center of the scrolls while the function of compressing the gas is effected, the oil contained in the compressed gas seals fine gaps which may be produced at the contacting areas between the side walls of the wrap plates 1*a*, 2*a* and the end surfaces of the wrap plates to the surfaces of the scrolls. The compressed gas is introduced into the discharge chamber 11 through the discharge conduit 1*c* and the discharge port 4*a*, and then, is fed to the annular chamber 12 through the communication hole 13. The annular chamber 12 has a substantially large volume. Accordingly, the oil is separated from the compressed gas, and the gas alone is discharged in the atmosphere through the discharge tube 28.

The oil 30 separated from the gas is condensed at the bottom portion of the annular chamber 12 and fills in the throttling path 33 formed between the upper surface of the circular plate 1*b* of the driving scroll 1 and the lower surface of the upper housing 9, whereby the atmospheric pressure is applied to the upper surface of the driving scroll 1 through the oil 30 in the annular chamber 12.

In the case that the driving scroll 1 is adapted to be movable in the axial direction, the driving scroll 1 is moved downwardly by the atmospheric pressure applied on the upper surface of the driving scroll 1 so that the gaps formed between the end surface of the wrap plate 1*a* of the driving scroll 1 and the front surface of the driven scroll 2 and between the end surface of the wrap plate 2*a* of the driven scroll and the front surface of the driving scroll 1 are reduced to thereby provide effective sealing.

In the case that the bearings 14, 15 are adapted to bear a thrusting force of the driving scroll 1, the pressure applied on the upper surface of the driving scroll is born by the bearings 14, 15.

The oil 30 condensed at the bottom of the annular chamber 12 flows in the suction chamber 32 through the throttling path 33.

An amount of the oil 30 flowing through the throttling path 33 is determined by the difference between the atmospheric pressure in the annular chamber and the pressure in the suction chamber 32. The oil 30 remaining in the throttling path 33 seals the suction chamber 32 against the annular atmospheric pressure chamber 12. The oil 30 falls in the oil reservoir 29 and is again entrained in the compression chamber 3 together with the gas sucked in the suction chamber 32. The function of the oil 30 provides the sealing of the suction chamber 32 to the annular chamber 12, whereby a highly vacuumed condition is obtainable in the suction chamber.

The oil 30 also lubricates the bearings 14, 16 during the circulation. The bearing 15 is lubricated by the splashed oil. In stead of this, the bearing 15 may be a grease-sealed roll bearing or a self-lubricating bearing.

Figure 2:
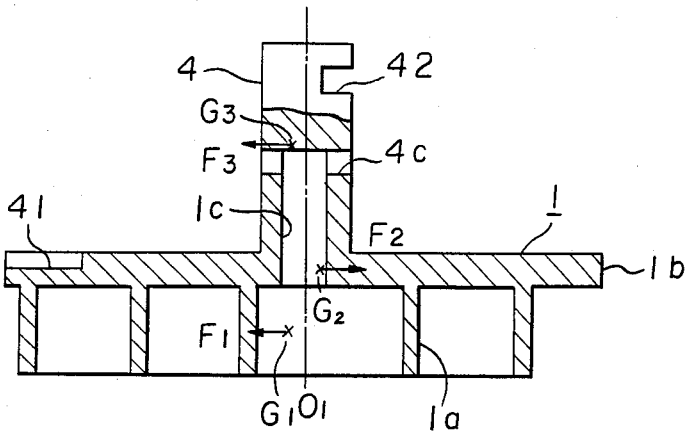
FIG. 2 is a longitudinal cross-sectional view showing a second embodiment of the driving scroll used for the present invention.
Figure 3:
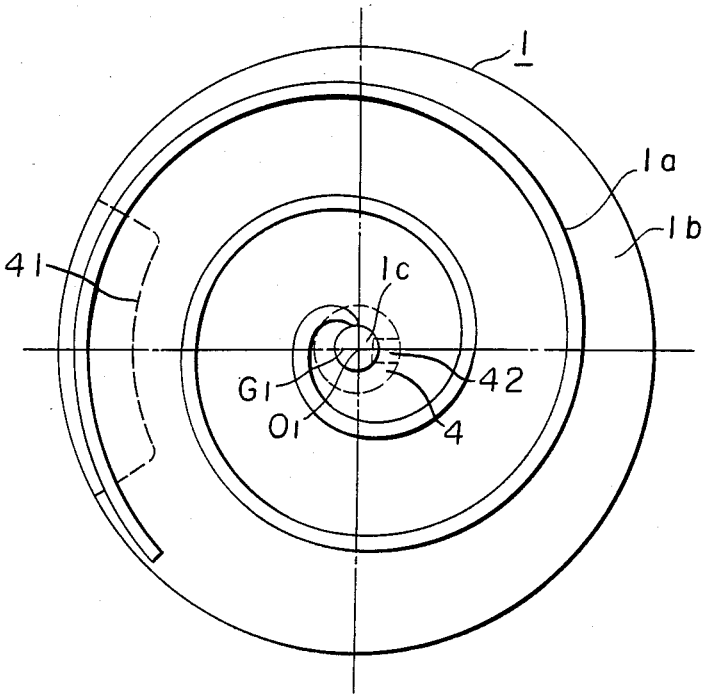
FIG. 3 is a plane view of the driving scroll as shown in FIG. 2.

FIGS. 2 and 3 are respectively a longitudinal cross-sectional view and a plane view of the driving scroll according to another embodiment of the present invention.

Since the wrap plate 1*a* of the driving scroll 1 is asymmetric with respect to the axial center $O_1$, and the center of gravity $G_1$ of the driving scroll 1 is deflected from the axial center $O_1$, an eccentric force $F_1$ acts on the axial center $O_1$ due to the centrifugal force caused by the revolution of the driving scroll 1. A load corresponding to the force $F_1$ is applied to the bearings 15, 16. In this embodiment, however, the driving scroll 1 is statically and dynamically balanced by forming a cut portion 41 at the outer circumferential part of the circular plate 1*b* to cancel the deflection of the gravity center $G_1$ and a cut portion 42 in the driving shaft 4 at a position opposite the deflection of the gravity center $G_1$. The provision of the cut portion 41 moves the gravity center of the circular plate 1*b* to a point $G_2$ and the cut portion 42 moves the gravity center of the driving shaft 4 to a point $G_3$ which are respectively deflected from the axial center $O_1$. Thus, these forces $F_1$, $F_2$ and $F_3$ are canceled as a whole of the driving scroll 1 so that the revolutional movement of the driving scroll 1 is balanced and no force is applied to the bearings 15, 16.

The driven scroll 2 may be provided with the cut portions as well as those in the driving scroll.

Weights may be attached to at least one of the scrolls 1, 2 instead of the cut portions 41, 42 so that the driving and/or the driven scroll is statically and dynamically balanced.

Thus, the scroll-type vacuum pump is constructed in such a manner that the driving scroll is placed at the upper part inside of the container; the driven scroll is placed below the driving scroll so that the driven scroll is rotated by the revolution of the driving scroll; the lower housing is gas-tightly attached to the bottom of the container to support the driven scroll through the bearing; the upper housing is gas-tightly attached on the top of the container so as to support the driving shaft of the driving scroll through the bearing supporting part formed at the central portion of the upper housing; the annular chamber is formed at the outer circumferential portion of the bearing supporting part so as to maintain the atmospheric pressure; the oil reservoir is formed at the lower part of the container, and the throttling path is formed between the lower part of the annular chamber and the upper surface of the driving scroll, whereby the oil fed to the annular chamber through the compression chamber and the discharge conduit formed in the driving shaft is held in the throttling path to thereby separate the suction chamber in the container from the annular chamber maintained at the atmospheric pressure. Accordingly, the scroll-type vacuum pump of the present invention provides a highly vacuumed condition while the entire construction is simple.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll-type vacuum pump which comprises:

a container of a cylindrical form which is provided with a gas inlet for introducing gas, wherein a portion of said container communicated with said gas inlet forms a suction chamber, a driving scroll rotatably placed inside said cylindrical container, said driving scroll comprising a circular plate and a wrap plate extending downwardly therefrom, and a driving shaft extending upwardly in which a discharge conduit is formed along its axial center, a driven scroll having a circular plate and a wrap plate, said driven scroll being placed below said driving scroll, said wrap plates of said driving scroll and said driven scroll cooperating with one another to define a compression chamber and being in mutual contact so that said driven scroll is driven by said driving scroll through the mutual contact between both wrap plates, a lower housing for gas-tightly closing the bottom of said cylindrical container and supporting said driven scroll through a bearing, an upper housing for gas-tightly closing the top of said cylindrical container, which upper housing comprises a bearing supporting part for supporting said driving scroll through a bearing, an annular chamber formed at the outer circumferential portion of said bearing supporting part, an opening in said upper housing at a position so as to maintain the annular chamber at atmospheric pressure and a further opening passing through said bearing supporting part in the radial direction to communicate said discharge conduit with said annular chamber, said annular chamber having a large volume, a driving source mounted on said upper housing and having a rotary shaft connected to said driving shaft of the driving scroll for driving said driving shaft, whereby air in said compression chamber is compressed, an oil storing portion formed in the lower part of said container, and a throttling path formed between a lower surface of said upper housing and an upper surface of said driving scroll, said annular chamber being communicated with said oil storing portion through the throttling path, wherein oil is taken in said compression chamber by the associated revolution of said driving and driven scrolls and is fed to said annular chamber kept at atmospheric pressure so that the oil may be separated from the compressed air and stored on the bottom of the annular chamber by the throttling action of said throttling path, whereby the oil hermetically seals said suction chamber from said annular chamber.

2. The scroll-type vacuum pump according to claim 1, wherein said driving scroll is supported by said upper housing so as to be movable in its axial direction so that the end surface of the wrap plate is brought into contact with a front surface of said driven scroll by the action of the atmospheric pressure in said annular chamber through the oil stored in the annular chamber.

3. The scroll-type vacuum pump according to claim 1, wherein said bearing supported by said bearing supporting part is adapted to bear a thrusting force applied to said driving scroll due to the atmospheric pressure in the annular chamber.

4. The scroll-type vacuum pump according to claim 1, wherein an oil guage is mounted on the container so that the surface level of oil is observed.

5. The scroll-type vacuum pump according to claim 1, wherein said discharge conduit formed in the driving shaft of the driving scroll communicates with said compression chamber.

6. The scroll-type vacuum pump according to claim 1, wherein a cut portion is formed in at least one of said scrolls so as to prevent an unbalanced centrifugal force due to eccentricity of said one of said scrolls.

* * * * *